US006748776B2

(12) United States Patent
Bullock et al.

(10) Patent No.: US 6,748,776 B2
(45) Date of Patent: Jun. 15, 2004

(54) LOCKING HANDLE ASSEMBLY FOR A DOOR

(75) Inventors: Charles E. Bullock, Waukegan, IL (US); William S. Hansen, II, Mettawa, IL (US)

(73) Assignee: A. L. Hansen Manufacturing Co., Waukegan, IL (US)

( * ) Notice: Subject to any disclaimer, the term of this patent is extended or adjusted under 35 U.S.C. 154(b) by 0 days.

(21) Appl. No.: 10/253,044

(22) Filed: Sep. 23, 2002

(65) Prior Publication Data

US 2004/0055344 A1 Mar. 25, 2004

(51) Int. Cl.[7] ..... E05B 13/00

(52) U.S. Cl. ..... 70/212; 70/207; 292/336.3; 292/DIG. 30

(58) Field of Search ..... 70/207, 209, 210, 70/211, 212; 292/44, 52, 194, 240, 241, 256.5, 336.3, DIG. 20, DIG. 30

(56) References Cited

U.S. PATENT DOCUMENTS

| | | | | | |
|---|---|---|---|---|---|
| 281,989 | A | * | 7/1883 | Frazee et al. | 292/202 |
| 381,740 | A | * | 4/1888 | Wollensak | 292/204 |
| 388,002 | A | * | 8/1888 | Selle | 292/202 |
| 2,060,903 | A | * | 11/1936 | Santore | 292/241 |
| 3,237,981 | A | | 3/1966 | Peterson | |
| 3,281,177 | A | | 10/1966 | Tenenbaum | |
| 3,500,668 | A | * | 3/1970 | Henry | 70/212 |
| 3,674,962 | A | * | 7/1972 | Kroeger | 70/212 |
| 5,014,528 | A | * | 5/1991 | Roberts | 70/177 |
| 5,184,853 | A | | 2/1993 | Whatley | |
| 5,299,597 | A | * | 4/1994 | Fort et al. | 70/212 |
| 5,634,357 | A | * | 6/1997 | Nutter et al. | 70/210 |
| 5,664,448 | A | * | 9/1997 | Swan et al. | 70/224 |
| 5,743,118 | A | | 4/1998 | Anderson | |
| 6,068,308 | A | * | 5/2000 | Molzer | 292/336.3 |
| 6,119,494 | A | * | 9/2000 | Whitfield | 70/177 |
| 6,318,770 | B1 | * | 11/2001 | Molzer | 292/336.3 |

OTHER PUBLICATIONS

"Trailer Rear #1" and "Trailer Rear #2" sketches, 2 pages. Blueprint, "Part Number F111AXXXCRXX," (1991).

* cited by examiner

*Primary Examiner*—Lynne H. Browne
*Assistant Examiner*—Christopher Boswell
(74) *Attorney, Agent, or Firm*—Brinks Hofer Gilson & Lione

(57) ABSTRACT

A locking handle assembly includes a support member and a door comprising a longitudinally extending edge. The door is moveable between a closed position, wherein the door defines a plane and the edge is positioned adjacent the support member, and an open position. A first lock receiving member is mounted to the support member and a handle is pivotally mounted to the support member. The handle is pivotable between a locked position and an unlocked position about a pivot axis oriented substantially perpendicular to the plane of the closed door. The handle includes an elongated grippable member and a second lock receiving member. The handle does not extend across the edge of the door when the handle is in the unlocked position such that the door is moveable between the closed and open positions. The elongated grippable member extends across the edge of the door when the handle is in the locked position, wherein the first and second lock receiving members are aligned when handle is in the locked position. A method of locking and unlocking a door is also provided.

24 Claims, 3 Drawing Sheets

44
46
22
48
30
26
50
54
52
34
28
24
60
56

56
30
36
26
30
24
22
28
54
42
52
34
50
48
44
46

FIG.6
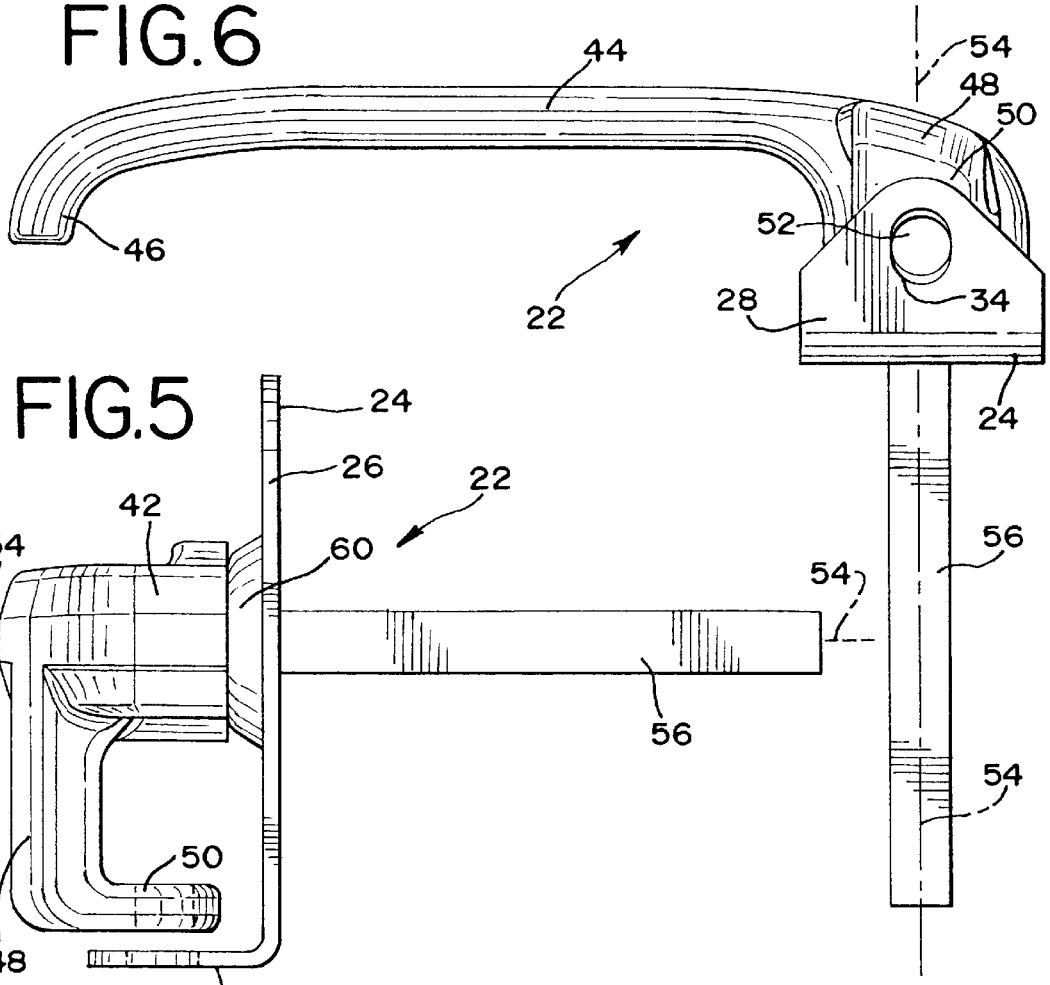
FIG.5
FIG.7
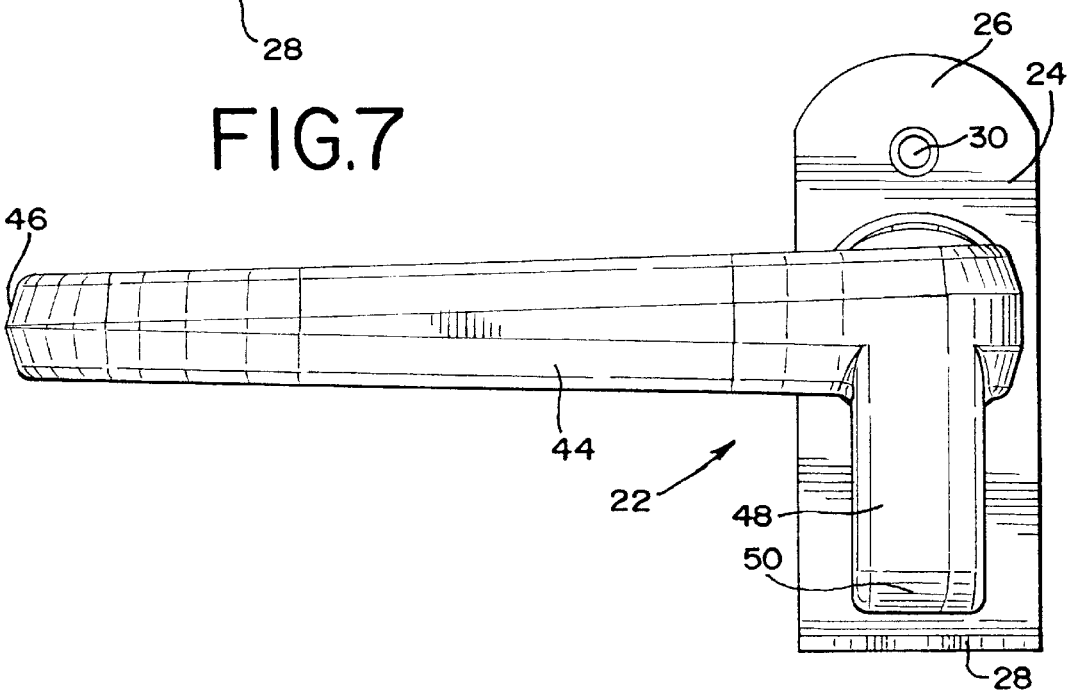

LOCKING HANDLE ASSEMBLY FOR A DOOR

BACKGROUND

The present invention relates generally to a locking handle assembly, and in particular, to a locking handle assembly having a handle pivotally mounted to a support member adjacent a door and methods for the use thereof.

Typically, doors such as trailer doors are configured with handles that are either pivotally mounted to the door and releasably engage an adjacent frame, or are pivotally mounted to the frame and releasably engage the door. In the latter configuration, a lock receiving member is often mounted to the frame, such that a lock, such as a padlock, can be used to couple the handle to the lock receiving member and thereby secure the handle in a locked position, wherein the handle is releasably engaged with the door. Often, the frame is configured as a relatively thin corner post. Typically, the handle is moved from a locked position, where the handle is oriented parallel to the post in a substantially vertical orientation, to an unlocked position, where the handle is oriented perpendicular to the post in a substantially horizontal orientation.

In the unlocked position, the handle necessarily extends outward from the post, so as to allow the door to swing open. The outwardly extending door handle can protrude beyond the side of the trailer, or other structure, however, and obstruct or impede the travel of pedestrians, vehicles and other moving objects along the side of the trailer or other structure. In addition, since the handle typically does not extend across the door when in either the locked or unlocked position, the user is not provided with any indicia that the door is locked or is otherwise prevented from being opened.

SUMMARY

Briefly stated, in one preferred embodiment, a locking handle assembly includes a support member and a door comprising a longitudinally extending edge. The door is moveable between a closed position, wherein the door defines a first plane and the edge is positioned adjacent the support member, and an open position. A first lock receiving member is mounted to the support member and a handle is pivotally mounted to the support member. The handle is pivotable between a locked position and an unlocked position about a pivot axis substantially perpendicular to the plane of the closed door. The handle includes an elongated grippable member and a second lock receiving member. The handle does not extend across the edge of the door when the handle is in the unlocked position such that the door is moveable between the closed and open positions. The elongated grippable member extends across the edge of the door when the handle is in the locked position. The first and second lock receiving members are aligned when handle is in the locked position.

In another aspect, one preferred embodiment of a locking handle assembly includes a lock receiving member having a base and a first locking member extending from the base, preferably at a substantially right angle therefrom. The first locking member has a first opening. A handle is pivotally mounted to the base and includes an elongated grippable arm and a lock arm extending from the grippable arm, preferably at a substantially right angle therefrom. The grippable arm and the lock arm preferably lie substantially within the same plane. The lock arm includes a second locking member extending from the lock arm, preferably at a substantially right angle therefrom. The second locking member has a second opening. The handle is pivotable between a locked position, wherein the first and second openings are aligned, and an unlocked position, wherein the first and second openings are not aligned.

In yet another aspect, one preferred embodiment of a method of locking and unlocking a door includes moving a door having a longitudinally extending edge to a closed position, wherein the door defines a plane and the edge is positioned adjacent a support member having a first lock receiving member. The method further includes pivoting a handle mounted to the support member about a pivot axis substantially perpendicular to the plane from an unlocked position to a locked position. The handle includes an elongated grippable member and a second lock receiving member. The handle does not extend across the edge of the door when the handle is positioned in the unlocked position. The elongated grippable member extends across the edge of the door, and the first and second lock receiving members are aligned when the handle is in the locked position.

The presently preferred embodiments provide significant advantages over other locking handle assemblies. In particular, the elongated grippable portion of the handle extends inwardly across the door when in the locked position, and is preferably aligned with and overlies the support member when in the unlocked position. The advantages of these orientations are at least two fold. First, the elongated grippable portion does not extend outwardly away from the door when in the unlocked position. Accordingly, the grippable portion does not impede or obstruct travel adjacent to, or movement past, the support member. Second, the elongated grippable portion extends across at least a portion of the door when in the locked position, thereby providing visual indicia to the user and others that the door is locked, since the door cannot be opened with the handle extending across the door.

The foregoing paragraphs have been provided by way of general introduction, and are not intended to limit the scope of the following claims. The presently preferred embodiments, together with further objects and advantages, will be best understood by reference to the following detailed description taken in conjunction with the accompanying drawings.

BRIEF DESCRIPTION OF THE DRAWINGS

FIG. 5 is a side view of the locking handle assembly shown in FIG. 3.

FIG. 6 is a rear perspective view of a portion of a locking handle assembly with the locking handle in a locked position.

FIG. 7 is a front view of the locking handle assembly shown in FIG. 3.

DETAILED DESCRIPTION OF THE PRESENTLY PREFERRED EMBODIMENTS

Figure 1:
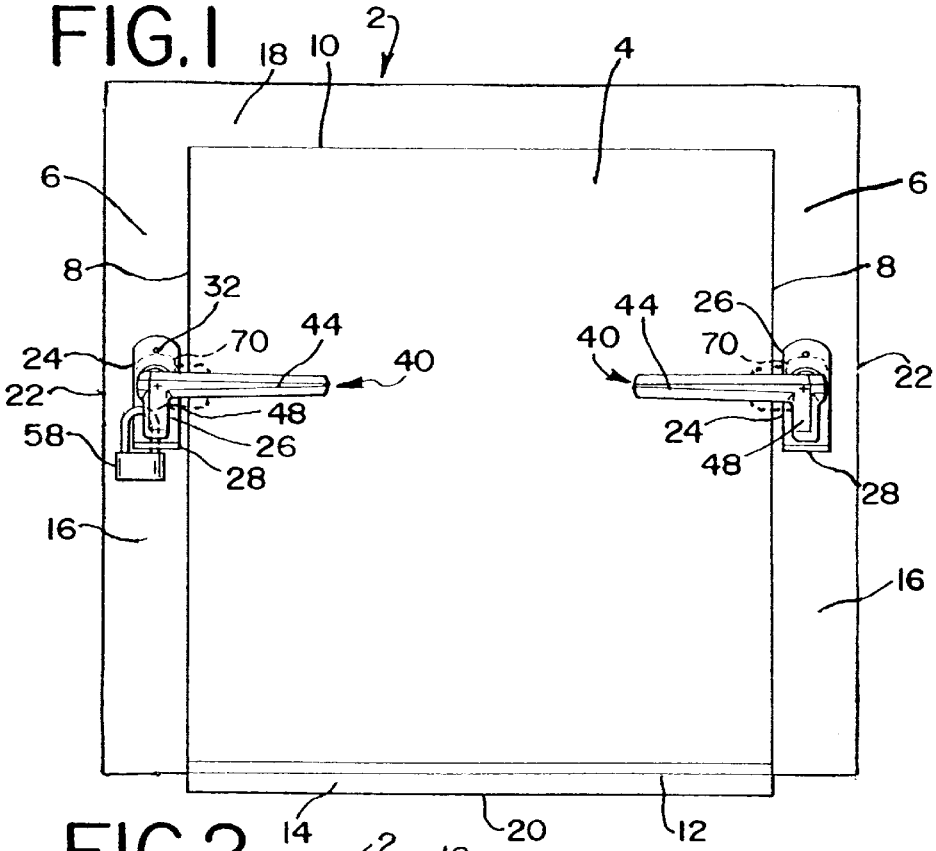
FIG. 1 is a rear view of a trailer having a door and two locking handles in a locked position.
Figure 2:
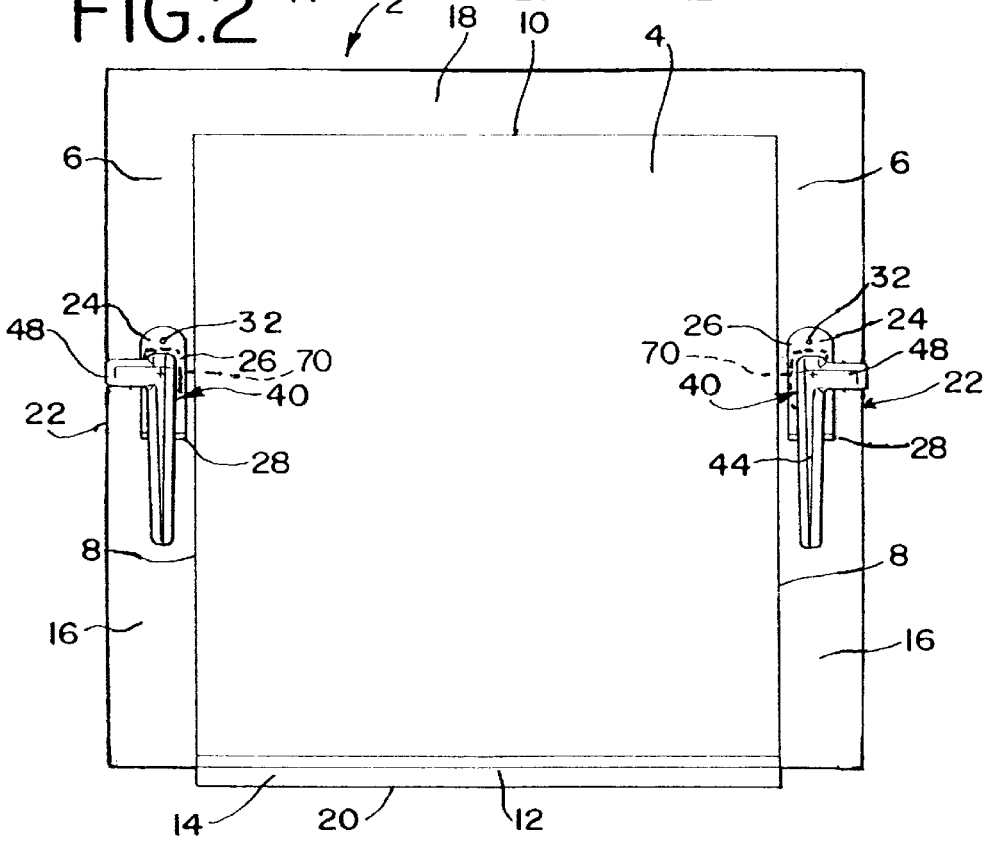
FIG. 2 is a rear view of the trailer shown in FIG. 1 with a door and two locking handles in an unlocked position.
Figure 3:
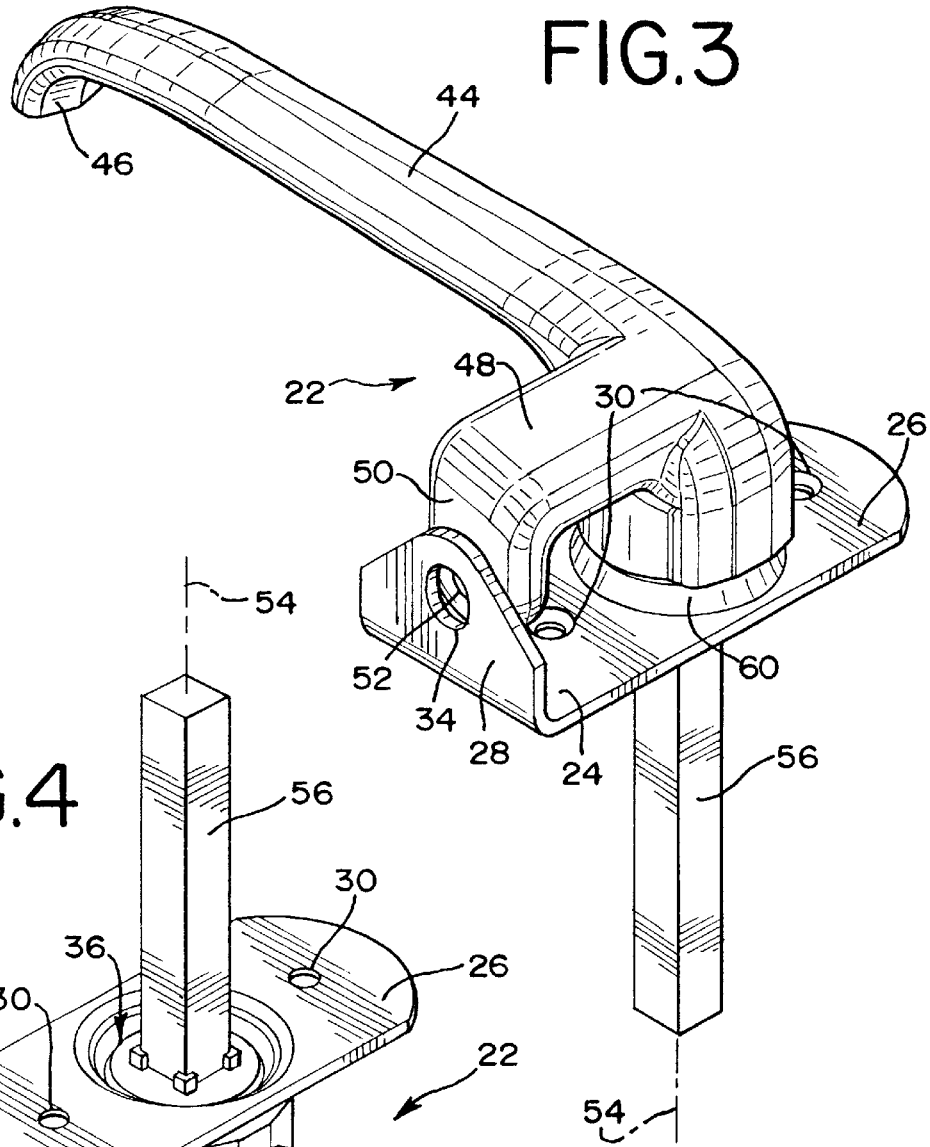
FIG. 3 is a front perspective view of a portion of a locking handle assembly with the locking handle in a locked position.
Figure 4:
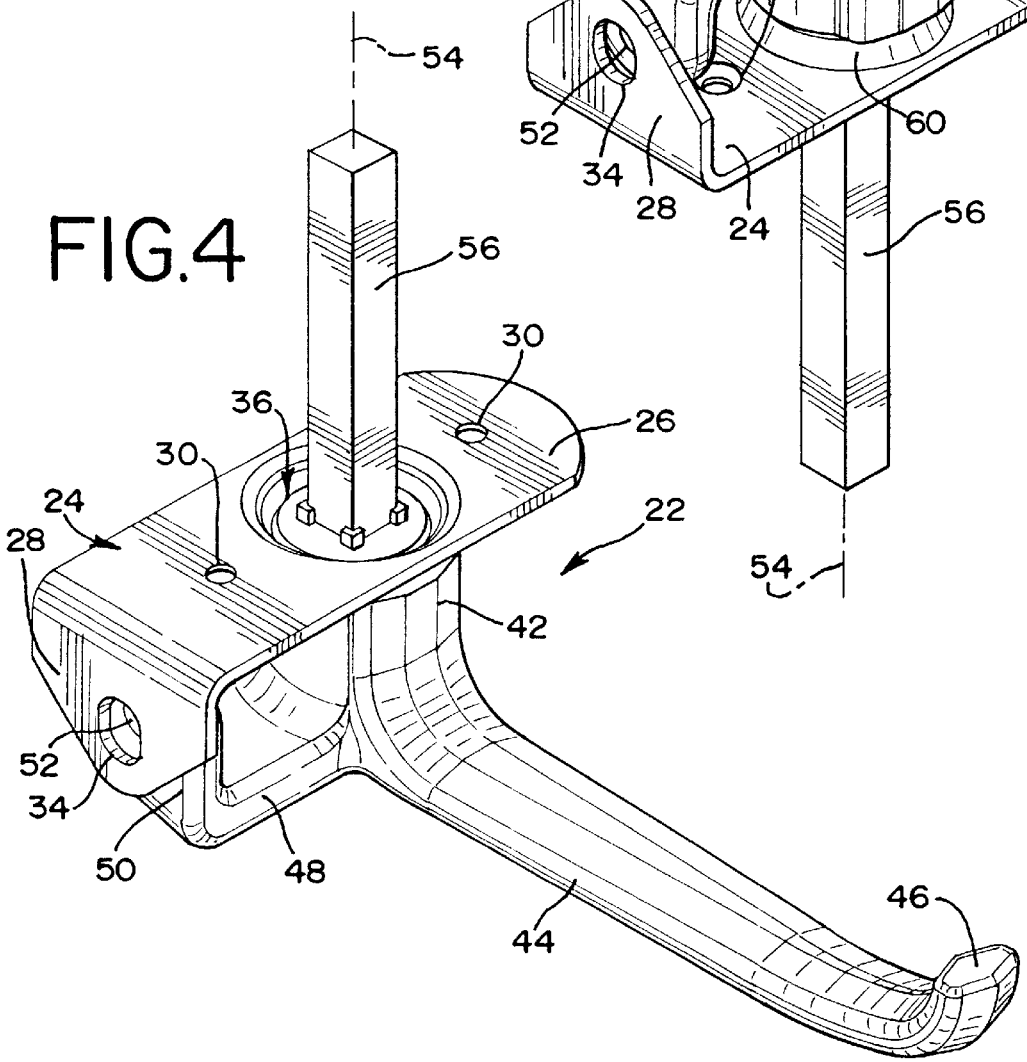
FIG. 4 is a rear perspective view of a portion of a locking handle assembly with the locking handle in a locked position.

Referring to FIGS. 1 and 2, a trailer 2 is shown as including a support structure 6 and a door 4 pivotally mounted to the support structure. Preferably, the door 4 is rectangular or square and has a periphery defined by four edges, preferably including a pair of opposite side edges 8, a top edge 10 and a bottom edge 12. It should be understood that the door can assume other shapes, including for example and without limitation various hexagonal, circular, oval and obround shapes. In one preferred embodiment, the door 4 is pivotally or hingedly mounted to the support structure along the bottom edge 12 thereof, for example with a pin or other hinge structure 14. Of course, it should be understood that the door can be pivotally mounted to the support structure along any of the edges thereof.

Preferably, the support structure 6 includes a pair of opposite side support members 16, a top support member 18 and a bottom support member 20, which preferably hingedly supports the door. In a preferred embodiment, the side support members are configured as elongated corner posts, which extend longitudinally in a substantially vertical direction. The term "longitudinal" and variations thereof as used herein means lengthwise, or in the lengthwise direction. It should be understood that the support structure can include only side members, or side members and a bottom member. In addition, it should be understood that the term "support member" is broadly defined as any member that supports another member, and includes without limitation post members, frame members, web members, such as sheet metal, and other types of structures.

The door 4 is preferably pivoted about its bottom edge 12 between an open position, wherein the door 4 extends rearwardly from the trailer 2, or door frame 6, and a closed position, wherein the side edges 8 of the door extend longitudinally in the vertical direction adjacent the side support members 16. The door defines a first plane when in the closed position, and a second plane when in the open position, with the second plane being non-parallel to the first plane, and with the first and second planes forming an angle therebetween.

Referring to FIGS. 1–7, preferably a pair of locking handle subassemblies 22 are mounted to the side support members 16 on opposite sides of the door 4. It should be understood that the subassembly can be mounted to any support member adjacent an edge of the door, including a top edge and bottom edge. It should also be understood that only a single subassembly can be used to lock the door in the closed position, for example when positioned opposite the hinge axis of the door. Conversely, the subassemblies can be mounted to the door.

The locking handle subassembly 22 includes a 24 first lock receiving member 24 mounted to the support member 16. Preferably, the first lock receiving member 24 includes a base 26 and a locking member 28 extending substantially perpendicular from the base 26. Preferably the base 26 is elongated and has a longitudinal extent that overlies the longitudinally extending support member 16, which is preferably configured as a post member. A pair of openings 30 are formed in the base 26 to receive fasteners, which are used to mount the first lock receiving member 24 to the support member 16. It should be understood that the lock receiving member 24 can be secured to the support member 16 with various mechanical fasteners, such as bolts, studs, screws and rivets, or it can be welded or otherwise bonded to the support member. Preferably, the lock receiving member 24 is preferably made of steel, stainless steel, or other metals or hard plastics, and can be formed by any know means, including for example and without limitation by stamping.

An opening 34 is preferably formed through the locking member 28. Preferably, the opening 34 is dimensioned and shaped to receive a lock member 58, such as a clasp or shank from a padlock or a pin. The base 26 is also provided with a large opening 36 formed therethrough. Preferably, the periphery of the opening 36 is raised or swaged to provide a raised bearing surface 60 for a handle 40. The base can also be formed without a raised surface.

The handle 40 includes a base 42 and an elongated grippable member 44, preferably configured as an arm, extending from the base 42. Preferably, the grippable arm 44 is about 5–10 inches long, and more preferably about 7.5 inches long. The handle is preferably made of metal, by any known process, including for example and without limitation as a zinc die casting, cast iron or stainless steel, or aluminum. The handle can also be made of hard plastic or other materials. The handle 40 also preferably includes a lock arm 48, or lock receiving member, which is preferably shorter than the grippable arm 44, e.g., 25–33% of the grippable arm length, and which extends substantially perpendicular therefrom. Preferably, the grippable arm 44 and lock arm 48 are substantially formed in a third plane, which lies substantially parallel to the plane of the door when in the closed position. In one preferred embodiment, the grippable arm 44 may include a downtumed end portion 46, which helps locate the user's hand on the grippable arm.

The lock arm 48 includes a locking member 50 extending substantially perpendicular therefrom and substantially parallel to the locking member 28 of the first lock receiving member 24 when the handle 40 is in a locked position. An opening 52 is formed through the locking member 50 and is dimensioned and shaped to receive a portion of the lock member.

The handle 40, and in particular the base 42, is pivotally mounted to the first lock receiving member 24 about a pivot axis 54, which is preferably horizontally oriented and substantially perpendicular to the plane of the closed door. In this way, the handle 40 is mounted to the support member 16 by way of the first lock receiving member 24. It should be understood that the handle can alternatively be directly mounted to the support structure, and that the terms "mounted" and "coupled" as used herein, mean directly connected, or indirectly connected by way of one or more other members.

The handle 40 includes a drive shaft 56 that extends through the opening 36 formed in the base. The drive shaft 56 extends through an opening in the support 16. A door engaging member 70 is coupled to the end of the drive shaft 56, and is preferably disposed or mounted in or on the support member 6. The door engaging member can be any conventional latch mechanism that is operative to engage the door, or a latch receiving member disposed thereon. Suitable latch mechanisms include for example and without limitation latch nos. 105, 107 and 111 (part numbers F105XXXXZNXX, F107XXXXZNXX, and S111CCNSZNXX) available from A. L. Hansen Manufacturing Co., the assignee of the present application.

In operation, the locking handle subassembly 22 and in particular the handle 40, is positioned in the unlocked position as shown in FIG. 2. In this position, the grippable member 44 of the handle is oriented in a substantially vertical orientation in an overlying relationship with the support member 16. The lock arm 48, which is relatively short, extends laterally outwardly, or transversely, from the grippable member 44, and does not extend, if at all, a substantial amount outwardly from the support member 16. In this position, the locking members 28, 50 of the first and second lock receiving members 24, 48 are not aligned, such that a lock member cannot be secured through the openings 34, 52 formed therein.

When the locking handle assembly is in the unlocked position, the door 4 can be moved between the open and closed positions. When the door 4 is moved to the closed position, the door handle 40 is pivoted about the axis 54 to the locked position. In this position, the grippable member 44 extends across the side edge 8 of the door 4. Preferably, the grippable member 44 extends in a substantially horizontal direction across a portion of the door 4. As the handle 40 is pivoted about the axis 54, the opening 52 formed in the locking member 50 of the lock arm 48, or second lock receiving member, is brought into alignment with the opening 34 formed in the locking member 28 of the first lock receiving member 24. Preferably, the opening 34 is elongated, or slightly larger than the opening 50, so as to accommodate for tolerance buildup and to ease insertion of the lock member threrethrough. When the openings 34, 52 are aligned, the lock member 58 is secured through the openings, which thereby prevents the handle 40 from being pivoted about the axis. As the handle 40 is pivoted to the locked position, the drive shaft 56 rotates and thereby brings the door engaging member into latching engagement with the door 4, thereby latching the door 4 in the closed position.

By virtue of the grippable member 44 crossing the edge 8 of the door and extending across at least a portion thereof, the user and others are provided with indicia and are notified that the handle 40 is in the locked position. Accordingly, even a quick glance at the door 4 will apprise the user that the door 4 is locked. At the same time, when the handle 40 is in the unlocked position, the elongated grippable member 44 is substantially aligned with the support member 16. In this position, the grippable member 44 does not impede the movement of the door 4, and also does not impede or obstruct movement along the lateral outboard side of the support structure 6. At the same time, the shorter lock arm 48 also does not extend substantially beyond the outermost periphery of the side support members 16, and preferably not at all in some preferred embodiments, so as to minimize interference with movement along the side of the support structure.

In an alternative embodiment, wherein the locking handle subassembly is mounted on the door, a support member engaging member is also mounted on or in the door and is coupled to the drive shaft of the subassembly. The support member engaging member releasably engages the support member, or a latch receiving member thereon. In this alternative embodiment, the grippable member preferably crosses the edge of the door when the handle is in the locked position, and the handle does not extend across the edge of the door when in the unlocked position.

Although the locking handle assembly 22 has been described herein in conjunction with a trailer, it should be understood that it would work equally well in any application having a door and a support structure, including various fixed structures, such as buildings and the like. In the same vein, although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A locking handle assembly comprising:

a support member;

a door comprising a longitudinally extending edge, wherein said door is moveable relative to said support member between a closed position and an open position, wherein said door defines a plane and said edge is positioned adjacent said support member when said door is in said closed position, and wherein at least a portion of said edge is spaced apart from said support member when said door is in said open position;

a first lock receiving member mounted to said support member; and a handle pivotally mounted to said support member, wherein said handle is pivotable relative to said support member between a locked position and an unlocked position about a pivot axis oriented substantially perpendicular to said plane, said handle comprising an elongated grippable member and a second lock receiving member, wherein said handle does not extend across said edge of said door when said handle is in said unlocked position such that said door is moveable between said closed and open positions, and wherein said elongated grippable member extends across said edge of said door when said handle is in said locked position, wherein said first and second lock receiving members are aligned when said handle is in said locked position.

2. The locking handle assembly of claim 1 wherein said elongated grippable member is substantially parallel to said longitudinally extending edge of said door when said handle is in said unlocked position.

3. The locking handle assembly of claim 1 wherein said second lock receiving member comprises at least a portion that extends substantially perpendicular to said elongated grippable member and substantially perpendicular to said pivot axis.

4. The locking handle assembly of claim 1 wherein said support member comprises an elongated post member lying substantially parallel to said edge of said door when said door is in the closed position.

5. The locking handle assembly of claim 1 wherein said edge comprises a side edge and wherein said door further comprises a bottom edge formed substantially perpendicular to said side edge, wherein said door is pivotable about said bottom edge between said closed and open positions.

6. The locking handle assembly of claim 1 wherein said first and second lock receiving members each have an opening dimensioned to receive a lock member, and wherein said openings of said first and second lock receiving members are aligned when said handle is in said locked position.

7. The locking handle assembly of claim 1 further comprising a door engaging member coupled to said handle, wherein said door engaging member is engaged with said door when said door is in said closed position and said handle is pivoted to said locked position, and wherein said door engaging member is disengaged with said door when said handle is pivoted to said unlocked position.

8. The locking handle assembly of claim 1 wherein said handle is pivotally mounted to said first lock receiving member about said pivot axis.

9. A locking handle assembly comprising:

a lock receiving member having a base and a first locking member extending from said base, wherein said first locking member has a first opening; and a handle pivotally mounted to said base, wherein said handle is pivotable relative to said base about a pivot axis, said handle comprising an elongated grippable arm and a lock arm extending transversely from said grippable arm, wherein said lock arm is substantially perpendicular to said pivot axis, wherein said lock arm comprises a second locking member extending from said lock arm, wherein said second locking member has a second opening, wherein said handle is pivotable about said pivot axis between a locked position, wherein said first and second openings of said first and second locking members are aligned and are adapted to receive a lock member therethrough, and an unlocked position, wherein said first and second openings are not aligned.

10. The locking handle assembly of claim 9 further comprising a drive shaft extending from said handle in the direction of said pivot axis, and a door engaging member coupled to said drive shaft.

11. The locking handle assembly of claim 9 wherein said base is elongated, and wherein said grippable arm is substantially parallel to said elongated base when said handle is pivoted to said unlocked position.

12. The locking handle assembly of claim 11 wherein said grippable arm is substantially perpendicular to said elongated base when said handle is pivoted to said locked position.

13. The locking handle assembly of claim 9 wherein said lock arm extends substantially perpendicular from said grippable arm.

14. The locking handle assembly of claim 13 wherein said first locking member extends substantially perpendicular from said base and wherein said second locking member extends substantially perpendicular from said lock arm.

15. A method of locking and unlocking a door comprising:

moving a door comprising a longitudinally extending edge relative to a support member from an open position, wherein at least a portion of said edge is spaced apart from said support member, to a closed position, wherein said door defines a plane and said edge is positioned adjacent said support member, wherein said support member comprises a first lock receiving member; and pivoting a handle mounted to said support member relative to said support member about a pivot axis substantially perpendicular to said plane from an unlocked position to a locked position, wherein said handle comprises an elongated grippable member and a second lock receiving member, wherein said handle does not extend across said edge of said door when positioned in said unlocked position, wherein said elongated grippable member extends across said edge of said door when said handle is in said locked position, and wherein said first and second lock receiving members are aligned when said handle is in said locked position.

16. The method of claim 15 further comprising coupling said first and second lock receiving members with a lock member when said handle is in said locked position.

17. The method of claim 16 wherein said first and second lock receiving members each have an opening dimensioned to receive said lock member, wherein said openings of said first and second lock receiving members are aligned when said handle is in said locked position and wherein said openings of said first and second lock receiving members are not aligned when said handle is in said unlocked position, and wherein said coupling said first and second lock receiving members comprises inserting said lock member through said aligned openings of said first and second lock receiving members when said handle is in said locked position.

18. The method of claim 15 wherein said plane comprises a first plane, and further comprising moving said handle to said unlocked position and moving said door to an open position wherein said door defines a second plane lying substantially non-parallel to said first plane.

19. The method of claim 18 wherein said edge comprises a side edge and wherein said door further comprises a bottom edge formed substantially perpendicular to said side edge, and wherein said moving said door to said closed and open positions comprises pivoting said door about said bottom edge between said closed and open positions.

20. The method of claim 15 wherein said elongated grippable member is substantially parallel to said longitudinally extending edge of said door when said handle is in said unlocked position.

21. The method of claim 15 wherein said second lock receiving member extends substantially perpendicular to said elongated grippable member.

22. The method of claim 15 wherein said support member comprises an elongated post member lying substantially parallel to said edge of said door when said door is in the closed position.

23. The method of claim 15 wherein said pivoting said handle from said unlocked position to said locked position further comprises engaging said door with a door engaging member coupled to said handle when said door is in said closed position.

24. The method of claim 23 wherein said handle is pivotably mounted to said support member and further comprising a drive shaft mounted to said handle, wherein said door engaging member is coupled to said drive shaft.

* * * * *